US005873272A

United States Patent [19]

Thompson

[11] Patent Number: 5,873,272

[45] Date of Patent: Feb. 23, 1999

[54] DISPLAY CASE LOCK MECHANISM WITH FRONT-ASSEMBLED CORE

[75] Inventor: Robert L. Thompson, White Plains, N.Y.

[73] Assignee: Thompson Lock & Supply Corporation, Mamaroneck, N.Y.

[21] Appl. No.: 910,406

[22] Filed: Aug. 13, 1997

[51] Int. Cl.[6] ..... E05B 9/04; E05B 65/08

[52] U.S. Cl. ..... 70/100; 70/368; 70/371; 70/451; 70/DIG. 19

[58] Field of Search ..... 70/367–371, 95, 70/99, 100, 360, 361, 451, 466, DIG. 19

[56] References Cited

U.S. PATENT DOCUMENTS

| | | | |
|---|---|---|---|
| 977,085 | 11/1910 | Eras | 70/367 |
| 1,719,203 | 7/1929 | Taussig | 70/100 |
| 1,736,900 | 11/1929 | Carpenter | 70/360 |
| 1,772,747 | 8/1930 | Croning | 70/371 |
| 1,773,733 | 8/1930 | Jacobi | 70/367 |
| 1,913,963 | 6/1933 | Shinn | 70/368 |
| 2,059,697 | 11/1936 | Jacobi | 70/368 |
| 2,323,400 | 7/1943 | Jacobi | 70/368 |
| 2,430,391 | 11/1947 | Dequick | 70/368 |
| 3,071,958 | 1/1963 | Russo | 70/361 X |
| 3,102,411 | 9/1963 | Friedman | 70/100 |
| 3,199,323 | 8/1965 | Niilola | 70/367 |
| 3,345,838 | 10/1967 | Russell et al. | 70/100 |
| 3,780,549 | 12/1973 | Schlage | 70/368 X |
| 3,793,857 | 2/1974 | Schlage | 70/368 |
| 4,658,606 | 4/1987 | Tseng | 70/371 X |
| 4,722,204 | 2/1988 | Foshee | 70/100 |

FOREIGN PATENT DOCUMENTS

| | | | |
|---|---|---|---|
| 1463812 | 2/1977 | United Kingdom | 70/371 |

*Primary Examiner*—Lloyd A. Gall

*Attorney, Agent, or Firm*—St. Onge Steward Johnston & Reens LLC

[57] ABSTRACT

A lock for use in a display case with sliding doors can be assembled by inserting a lock core and securing it into a lock cylinder from the front of the display case. The lock cylinder has a front, a rear end, a central opening extending from the front to the rear. It is adapted to receive the lock core from the front and has a threaded hole near the front and transverse and open to the central opening. A screw is threaded into the threaded hole such that a portion of the screw extends into the central opening blocking removal of the core from the opening.

20 Claims, 2 Drawing Sheets

DISPLAY CASE LOCK MECHANISM WITH FRONT-ASSEMBLED CORE

TECHNICAL FIELD

The invention relates to a lock that can be easily assembled from the outside of a display case, yet once assembled is capable of locking sliding doors in a closed position.

Display cases are typically constructed with glass fronts and locking rear doors to permit browsing consumers to view items having more than nominal value, yet protect them from damage or theft. The rear doors can be held in locked position by lock assemblies that extend through a hole in one of the doors, typically in perimeter metal frome. Assembly of currently-available locks is difficult because the lock cylinder must be secured from the rear of the lock in most cases, and the rear of the lock is inside the case near a case wall—leaving little room for fingers or tools. The lock cylinders are usually attached to the doors prior to delivery, and the lock cores are inserted after delivery. Simply sliding the lock cores in place should be simple, but the installer must then reach inside the display case and, from behind, insert a screw to hold the core in place.

While a number of efforts have been made to address these problems, the art is in need of effective solutions.

BACKGROUND ART

Locks for sliding display case doors have been available in a number of configurations, but they have often been too difficult to assemble—not permitting assembly from the front of a display case without compromising security or some aspect of functionality.

In U.S. Pat. No. 1,500,297, Best describes a cylinder lock of the type for use with a standard bolt mechanism. It includes a casing for holding a core frame. The casing includes a groove, which can receive a screw to prevent the casing from turning when the key is turned. It also includes a hole through the side for receiving a screw to hold the core frame in place in the casing. The lock casing is threaded in the rear for engagement with a latch casing. The core does not slide within the casing to permit use for locking cabinet doors.

In U.S. Pat. No. 4,444,034, Best, et al., describe a lock of the type having a key-removable core, which slides within a core receptacle. Cores of this type are typically secured in a lock cylinder by a screw which is installed from the rear and operates as a stop to engage with a surface at the rear of the cylinder. This can be seen below in FIGS. 7*a*–7*c*, which reproduce the manufacturer's assembly drawings for a commercial lock of this type.

There remains a need for a lock that can be easily assembled from the outside of a display case, yet once assembled is capable of locking openable doors in a closed position.

DISCLOSURE OF THE INVENTION

It is an object of the invention to provide a lock that can be easily assembled and secured from the outside of a display case and, once assembled, is capable of locking sliding doors in a closed position.

This and other objects are achieved by the invention, which provides a lock for use in a display case and a method for assembling it. The lock comprises: a lock cylinder having a front, a rear end, a central opening extending from the front to the rear and adapted to receive a lock core, and a stop retaining means (e.g., a stop-holding groove or hole, preferably a threaded hole) near the front and transverse and open to the central opening; a lock core within the central opening; and a removable stop (e.g., a screw) inserted into the stop-retaining means such that a portion of the removable stop extends into the central opening blocking removal of the core from the opening.

The method of assembling the lock comprises: affixing a lock cylinder through a hole in a door, the lock cylinder having a front, a rear end, a central opening extending from the front to the rear and adapted to receive a lock core, and a stop-retaining means near the front and transverse and open to the central opening; sliding a lock core into the central opening from the front of the cylinder; and inserting a removable stop into the stop-retaining means such that a portion of the removable stop extends into the central opening blocking removal of the core from the opening.

Many of the preferred aspects of the invention are described below.

BRIEF DESCRIPTION OF THE DRAWINGS

The invention will be better understood and its advantages more apparent from the following detailed description, especially when read in light of the accompanying drawings, wherein.

DETAILED DESCRIPTION

Figure 1:
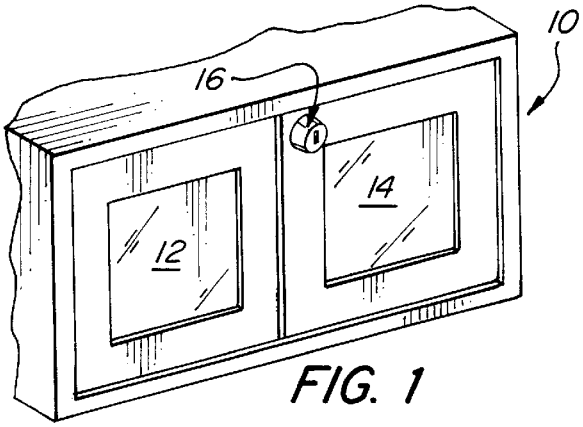
FIG. 1 is a perspective view of a display case having openable doors locked in a closed position.
Figure 2:
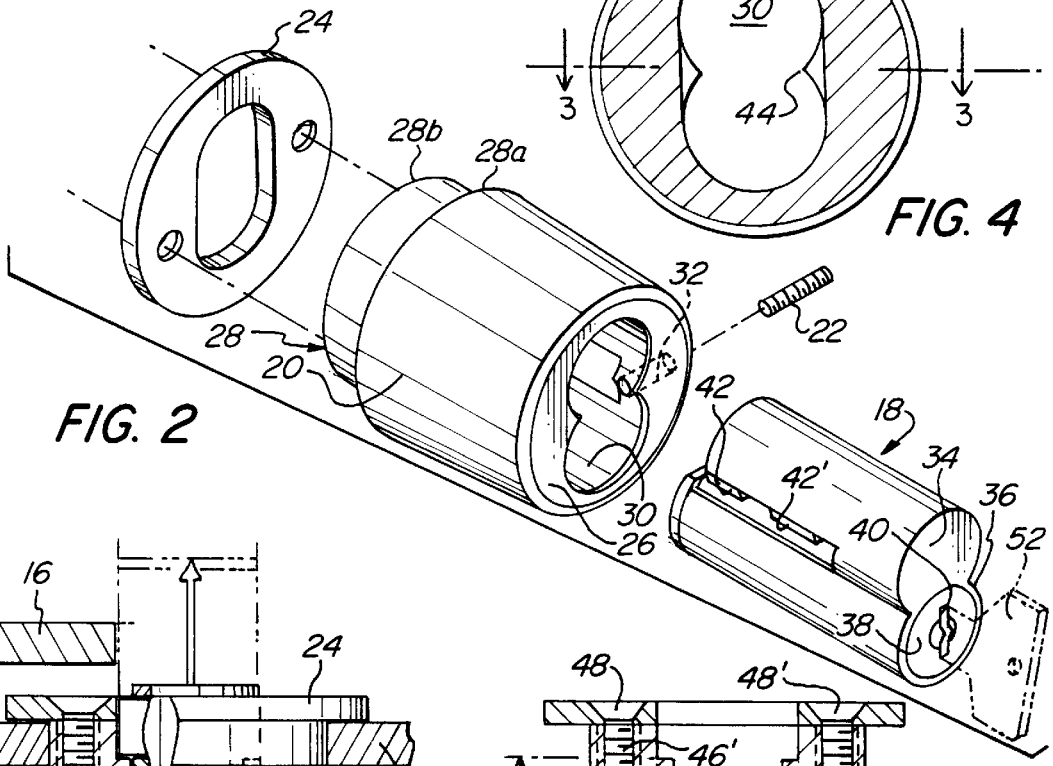
FIG. 2 is an exploded perspective view of the principal elements of a lock assembly of the invention.

Reference to FIG. 1 gives a perspective view of a display case 10 having sliding door panels 12 and 14 locked in a closed position by means of lock 16. The lock is shown in place in a perimeter metal frame of a type typically employed in installations of this type. FIG. 2 shows a preferred form of lock 16 in exploded perspective. The lock comprises a core 18, a lock cylinder 20, a screw 22 and a retention plate 24.

Figure 5:
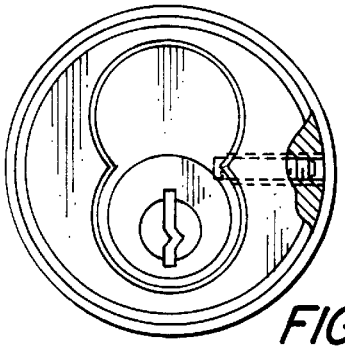
FIG. 5 is a front view of a lock assembly according to the invention.
Figure 4:
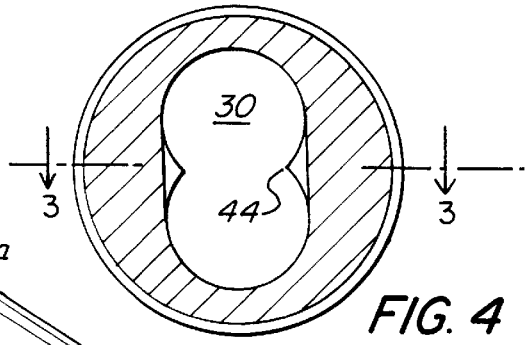
FIG. 4 is a cross sectional view of a lock casing according to the invention, the cross section taken along line 4—4 in FIG. 3.

The lock cylinder 20 has a front 26, a rear end 28, and a central opening 30 extending from the front 26 to the rear 28. The central opening 30 in the lock cylinder 20 is adapted to receive the lock core 18 which is easily inserted from the front and secured in place by a suitable removable stop, shown here as screw 22. The screw 22 is inserted in threaded hole 32 near the front of the cylinder 20. The hole 32 and the screw 22 inserted therein extend transverse to the central opening. The screw 22 is shown in place in FIG. 5, extending inwardly beyond the internal surface of the cylinder 20, which forms central opening 30. In another embodiment, the removable stop can be a spring washer (e.g., 60 in FIGS. 9 and 10) and the stop-holding means can be a groove 62 extending transverse to the central axis of the central opening 30.

Figure 7A:
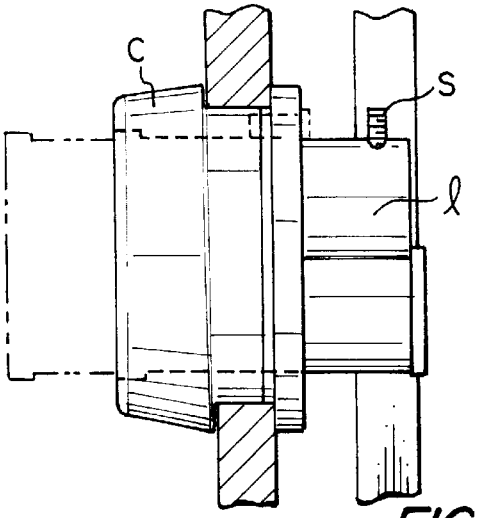
FIG. 7a (PRIOR ART)
FIGS. 7*a*–7*c* illustrate a prior art lock assembly.
Figure 7C:
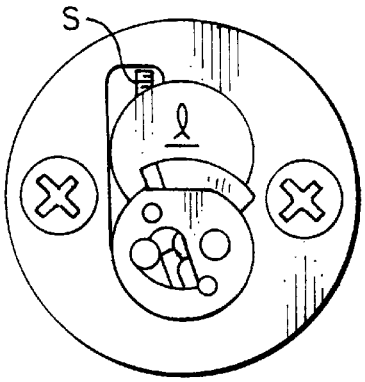
FIG. 7c (PRIOR ART)
Figure 7B:
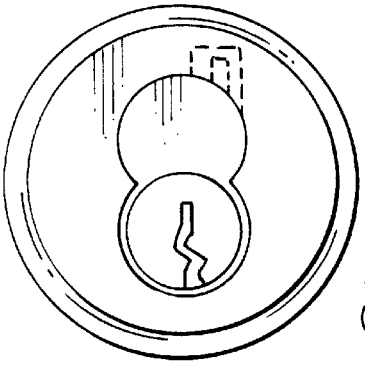
FIG. 7b (PRIOR ART)

The screw 22 extends into the central opening, blocking removal of the core from the opening. This configuration permits inserting the screw 22 (typically of the headless variety commonly used as a set screw, e.g., with an allen wrench opening) from the front of the door panels during assembly. This provides a distinct advantage over the prior art structure shown in FIGS. 7*a*–7*c*, which employ a smaller cylinder c and requires threading the screw S into the lock core l.

Figure 8:
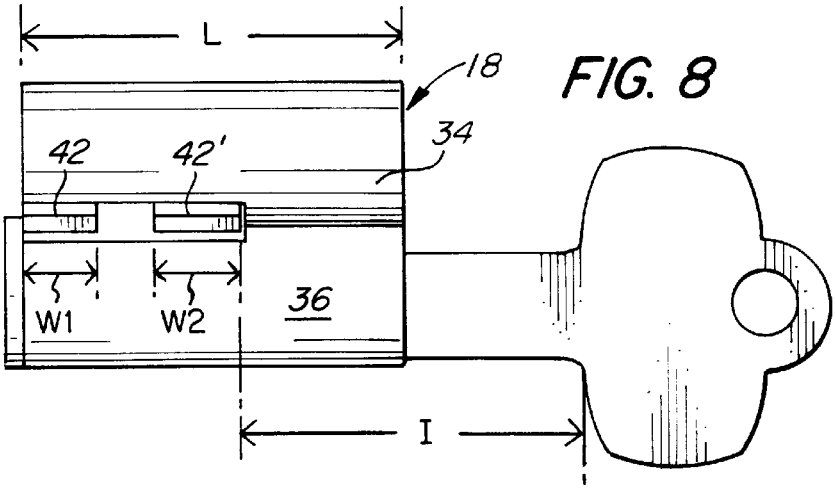
FIG. 8 illustrates some preferred dimensional relationships of the lock core and key.

The lock core 18 is comprised of two generally cylindrical portions 34 and 36, mated longitudinally to provide a figure-8 cross-sectional shape with necked-in portions along two sides. The upper portion is a tumbler lobe and houses the lock tumblers. The lower portion holds a key plug 38 having a key slot 40. It is of a type in wide commercial use and available from Best Lock Corporation, Arrow Lock, NT Falcon Lock, PDQ Manufacturing, KSP Killeen Security Locks, Inc., Medeco Security Locks, Inc., and Kaba High Security Locks.

At least one throw, e,g., 42, is connected to a key plug 38, arranged such that throws are extended as the key plug is rotated. The throws extend from a necked-in portion on a side of the lock core, at the juncture of the upper and lower portions 34 and 36. When the lock core is inserted within the central opening 30 of the lock casing, the throws mate with at least one stop in the central opening. The Figures show two throws, 42 and 42', configured complementarily with stop 44 to permit locking the core in a rearwardly-extending, door-locking position (shown in dotted lines in FIG. 6) and in a withdrawn, door-unlocked position (shown in solid lines in the same figure).

Figure 6:
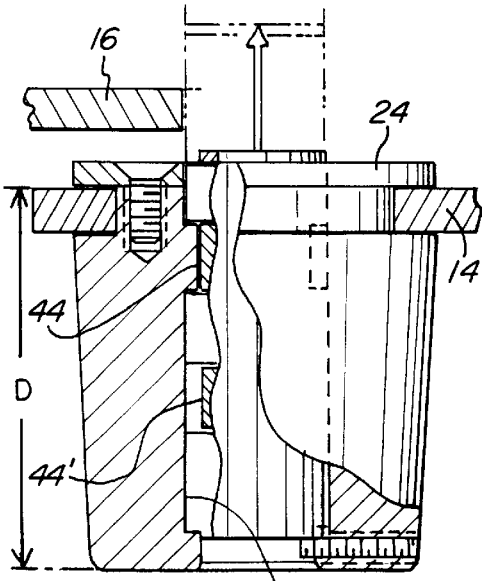
FIG. 6 is partially broken away top elevation of a lock assembly of the invention wherein a lock cylinder is shown in dotted lines extending to the locking position from a central opening within a lock casing.
Figure 3:
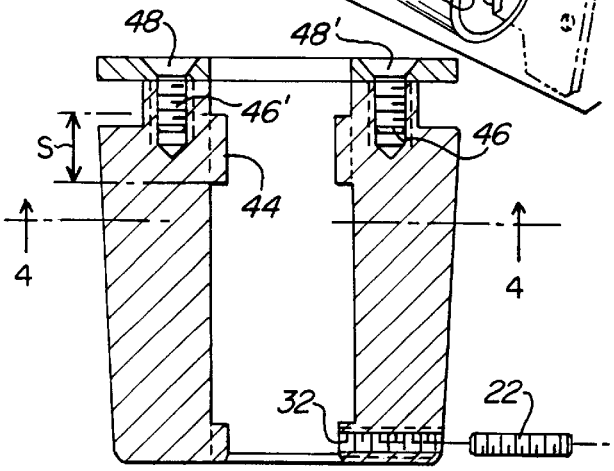
FIG. 3 is a cross sectional view of a lock casing according to the invention, the cross section taken along line 3—3 in FIG. 4.

FIG. 8 indicates that the lock core 18 has a length L and that each of the throws 42 and 42' have lateral extents W. Also shown in FIG. 8 is a length l, which is measured from the base of the handle of key 52 to the front face of throw 42'. FIG. 6 provides the dimensions of the depth D of the central opening 30 of lock cylinder 20. Desirably, the length L will be about the same as both depth D and length l. The space W is about the same as the dimension S of the stop 44.

It will also be noticed that the rear end 28 of the lock cylinder 20 has a portion 28*a* of diameter greater than an adjacent portion 28*b* of reduced diameter. The portion of reduced diameter is inserted through a hole in a door panel and affixed thereto, preferably prior to delivery to a store or other place where it will be used. Threaded holes 46, 46' in the rear of the lock cylinder 20 facilitate assembly to a sliding door panel. Plate 24, will be larger than the hole in the door panel and can be secured to the lock cylinder by screws 48,48'. Desirably, all locks for a particular installation can be operated by a single master key.

Figure 9:
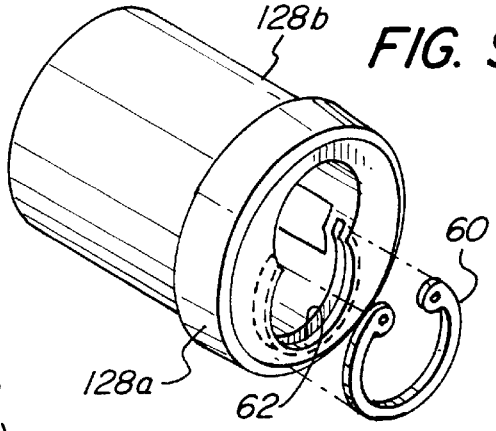
FIG. 9 is a front perspective view of an alternative embodiment of the invention.
Figure 10:
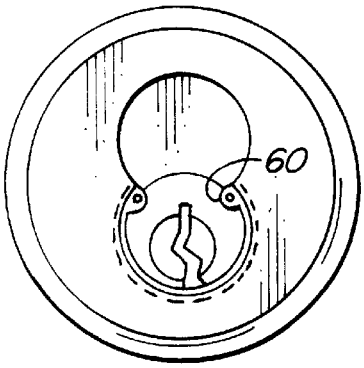
FIG. 10 is a front elevation of the embodiment of FIG. 9.

FIGS. 9 and 10 show alternative features to those of the other figures. For example, the removable stop means employed is a spring washer 60 and the stop-retaining means is a groove 62. Also in FIGS. 9 and 10, the cylinder is configured for use with a thicker door, e.g., a standard ¾ inch door. Here, the portion of reduced diameter 128*b* is sufficient in length to insert in a thick door, leaving only 128*a* extending from the door front. The lock cylinder is shown with no taper.

According to the method of the invention for assembling the lock, the lock core 18 is slid into the central opening 30 of the lock cylinder 20. Then, from the front, the screw 22 is inserted into the hole 32 and turned therein sufficiently to extend from the surface of 30 and provide a stop preventing the core 18 from sliding out again. The key, shown in phantom lines in FIG. 2, preferably cannot be removed in the unlocked position and will prevent the unlocked lock core from falling out the rear.

The above description is intended to enable the person skilled in the art to practice the invention. It is not intended to detail all of the possible modifications and variations which will become apparent to the skilled worker upon reading the description. It is intended, however, that all such modifications and variations be included within the scope of the invention which is defined by the following claims. The claims are meant to cover the indicated elements and steps in any arrangement or sequence which is effective to meet the objectives intended for the invention, unless the context specifically indicates the contrary.

I claim:

1. A lock for use in a display case, comprising:

a lock cylinder having a front, a rear end, a central opening extending from the front to the rear end and adapted to receive a lock core, and a stop-holding groove or hole near the front and transverse and open to the central opening;

an interchangeable lock core within the central opening, slidable therein between locked and unlocked positions; said lock core having a front face at a front end thereof facing outwardly of the lock cylinder and a removable stop inserted into the stop-holding groove or hole such that a portion of the removable stop extends into the central opening blocking removal of the core from the opening by engaging the front face of the lock core;

wherein said lock core is slidable between said locked and unlocked positions when said stop is extended to block removal of the core from the central opening.

2. A lock according to claim 1 wherein:

the lock core is comprised of two generally cylindrical portions mated longitudinally to provide a figure-8 cross-sectional shape with necked-in portions along two sides.

3. A lock according to claim 1 wherein:

the lock core includes a throw connected to a key plug, arranged such that the throw extends from a necked-in portion on a side of the lock core, to mate with at least one stop in the central opening.

4. A lock according to claim 1, which further comprises:

threaded holes in the rear end of the lock cylinder to facilitate assembly to a sliding door panel.

5. A lock according to claim 1 wherein:

the rear end of the lock cylinder has a portion of diameter greater than an adjacent portion of reduced diameter.

6. A lock according to claim 1 wherein:

the removable stop is a screw and the stop-holding groove or hole is a threaded hole.

7. A lock according to claim 1 wherein:

the removable stop is a spring washer and the stop-holding groove or hole is a groove.

8. A lock according to claim 1 which further includes a key and a throw and, wherein:

L is the length of the lock core, l a length measured from the base of a handle of the key, when inserted, to the front face of the throw, and D is the depth of the central opening of the lock cylinder, the length L is about the same as both depth D and length l.

9. A sliding door and a lock assembly, comprising:

a door panel having an exterior surface adapted to be fitted with a lock cylinder and having a hole therein adjacent to one edge;

a lock cylinder having a front, a rear end, a central opening extending from the front to the rear end and adapted to receive a lock core, and a threaded hole near the front and transverse and open to the central opening, the rear end having a portion of diameter greater than the hole in the door panel and a portion of reduced diameter extending from said exterior surface of the door panel into the hole therein;

an interchangeable lock core within the central opening;

a screw threaded into the threaded hole such that a portion of the screw extends into the central opening blocking removal of the core from the opening, wherein said lock core is slidable between locked and unlocked positions when said screw is extended to block removal of the core from the central opening;

threaded holes through the rear end of the lock cylinder;

a plate having a size greater than the hole in the door panel positioned on an opposite surface of the door panel to the lock cylinder; and screws attaching the plate to the lock cylinder.

10. A sliding door and a lock assembly according to claim 9 wherein:

the lock core is comprised of two generally cylindrical portions mated longitudinally to provide a figure-8 cross-sectional shape with necked-in portions along two sides.

11. A sliding door and a lock assembly according to claim 9 wherein:

the lock core includes a throw connected to a key plug, arranged such that the throw extends from a necked-in portion on a side of the lock core, to mate with at least one stop in the central opening.

12. A sliding door and lock assembly according to claim 9 which further includes a key and a throw and, wherein:

L is the length of the lock core, l a length measured from the base of a handle of the key, when inserted, to the front face of the throw, and D is the depth of the central opening of the lock cylinder, the length L is about the same as both depth D and length l.

13. A method of assembling a lock, comprising:

affixing a lock cylinder through a hole in a door, the lock cylinder having a front, a rear end, a central opening extending from the front to the rear end and adapted to receive a lock core, and a stop-holding groove or hole near the front and transverse and open to the central opening;

sliding a lock core into the central opening from the front of the cylinder; said lock core having a front face at a front end thereof facing outwardly of the lock cylinder and inserting a removable stop into the stop-holding groove or hole such that a portion of the removable stop extends into the central opening blocking removal of the core from the opening by engaging the front face of the lock core;

whereby said lock core is slidable between locked and unlocked positions when said stop is extended to block removal of the core from the central opening.

14. A method of assembling a lock according to claim 13 wherein:

the lock core is comprised of two generally cylindrical portions mated longitudinally to provide a figure-8 cross-sectional shape with necked-in portions along two sides.

15. A method of assembling a lock according to claim 13 wherein:

the lock core includes a throw connected to a key plug, arranged such that the throw extends from a necked-in portion on a side of the lock core, to mate with at least one stop in the central opening.

16. A method of assembling a lock according to claim 13, wherein the lock further comprises:

threaded holes in the rear end of the lock cylinder to facilitate assembly to a sliding door panel.

17. A method of assembling a lock according to claim 13 wherein:

the rear end of the lock cylinder has a portion of diameter greater than an adjacent portion of reduced diameter.

18. A method according to claim 13 wherein:

the removable stop is a screw and the stop-holding groove or hole is a threaded hole.

19. A method according to claim 13 wherein:

the removable stop is a spring washer and the stop-holding groove or hole is a groove.

20. A method according to claim 13 which further includes a key and a throw and, wherein:

L is the length of the lock core, l a length measured from the base of a handle of the key, when inserted, to the front face of the throw, and D is the depth of the central opening of the lock cylinder, the length L is about the same as both depth D and length l.

* * * * *